United States Patent [19]

Roth et al.

[11] 3,979,860

[45] Sept. 14, 1976

[54] ROOF AND WALL SEAL AND CANT

[75] Inventors: Abraham H. Roth; Dave Roth, both of Youngstown, Ohio

[73] Assignee: Roth Bros. Co. Inc., Youngstown, Ohio

[22] Filed: Feb. 13, 1975

[21] Appl. No.: 549,690

[52] U.S. Cl. ..... 52/61; 52/60; 52/302; 52/553

[51] Int. Cl.[2] ..... E04D 1/36; E04D 3/38

[58] Field of Search ..... 52/60, 61, 62, 553, 52/603, 300, 302, 303

[56] References Cited

UNITED STATES PATENTS

| | | | |
|---|---|---|---|
| 358,595 | 3/1887 | Cortright | 52/553 |
| 966,595 | 8/1910 | Posson | 52/553 |
| 1,782,246 | 11/1930 | Schneider | 52/60 |
| 1,804,315 | 5/1931 | Budd | 52/60 |
| 2,645,824 | 7/1953 | Titsworth | 52/303 |
| 2,702,514 | 2/1955 | Dalley | 52/62 |
| 2,789,493 | 4/1957 | Riggle | 52/302 |
| 2,968,263 | 1/1961 | Huston et al. | 52/302 |
| 2,974,448 | 3/1961 | Weis | 52/61 |
| 3,090,161 | 5/1963 | Edwards | 52/60 |
| 3,405,485 | 10/1968 | Edwards | 52/60 |
| 3,878,655 | 4/1975 | Toth | 52/60 |
| R17,818 | 9/1930 | Young | 52/61 |

*Primary Examiner*—Ernest R. Purser
*Assistant Examiner*—Robert C. Farber
*Attorney, Agent, or Firm*—Webster B. Harpman

[57] ABSTRACT

A roof and wall seal incorporating a cant forms a flexible water tight closure between a roof structure and a wall perpendicular thereto. A cant partially receives roofing material to form a seal and extends upwardly relative thereto in spaced relation to a supporting wall and a skirt movably secured to the wall above the cant depends thereover to complete the seal which provides ventilation and unusual flexibility.

6 Claims, 3 Drawing Figures

ROOF AND WALL SEAL AND CANT

BACKGROUND OF THE INVENTION

1. Field of the Invention

This invention relates to roof and wall structures and arrangements for effecting water tight closures therebetween.

2. Description of the Prior Art

Prior structures of this type have employed various arrangements of extending the roofing material upwardly and against a supporting wall or the like as seen in U.S. Pat. Nos. 2,641,203, 2,984,049 and 3,608,255. Still others have proposed that some of the roof and wall sealing construction be attached to the wall and various proposals may be seen in U.S. Pat. Nos. 1,884,259, 2,168,204 and 2,250,548.

The present invention provides an improved roof and wall seal and cant structure which permits unusual flexibility between the roof and the wall while providing a water tight seal therebetween and additionally provides for ventilation of the space beneath the roof.

SUMMARY OF THE INVENTION

A roof and wall seal and cant assembly extending between a flat built up roof and a fixed permanent wall to form a water tight seal therebetween includes a cant secured to the roof and extending perpendicular thereto and having a portion spacing the cant with respect to the wall. A skirt depends from the wall over and in front of the cant and the roofing material thereon to form a closure which is spaced with respect to the face of the wall to provide increased flexibility and ventilation of the space beneath the roof.

DESCRIPTION OF THE PREFERRED EMBODIMENT

Figure 1:
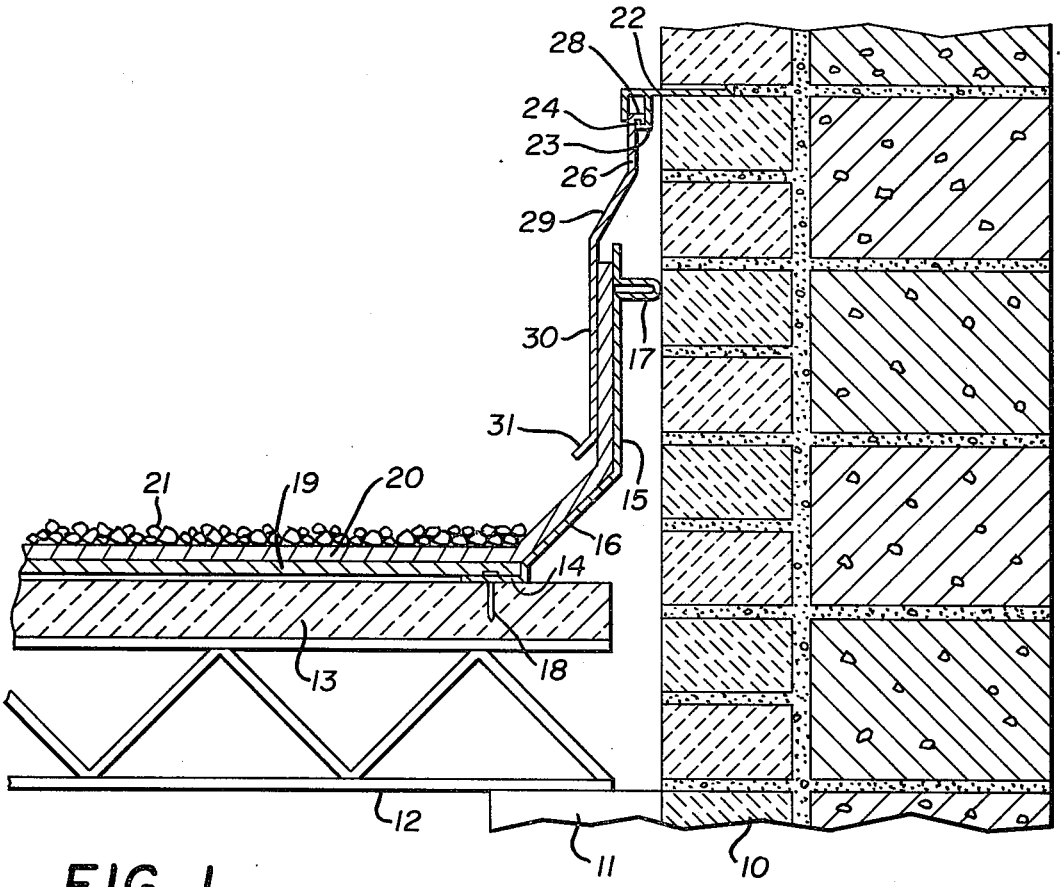
FIG. 1 is a vertical section through a portion of a roof structure and a masonry wall illustrating the roof and wall seal and cant.

In the form of the invention chosen for illustration herein, the roof and wall seal and cant comprises a structure joining a roof and a masonry wall and as seen in FIG. 1 of the drawings, a wall 10 having an inner support column 11 supports open truss joists 12 which in turn carry roofing slabs 13 as known in the art. A cant including a longitudinally extending horizontal portion 14 and a vertical section 15 has an inner connecting angular section 16. The vertical section 15 of the cant has a longitudinally extending spacing flange 17 therein inwardly from the upper longitudinal edge of the vertical section 15, the outermost portion of the spacing flange 17 resting against the adjacent surface of the wall 10. The cant is affixed to the roofing slabs 13 by fasteners such as nails 18 driven through the longitudinally extending horizontal portion 14 of the cant so as to position the cant as shown in FIG. 1 of the drawings with the vertical section 15 thereof in spaced relation to the face of the wall 10 adjacent thereto.

Roofing material as used in forming a built up roof is then applied. A first section of such roofing material being indicated by the numeral 19 has a second section section 20 positioned thereover which second section 20 extends upwardly on the angular section 16 of the cant and vertically against the vertical section 15 of the cant and may be secured thereto as with liquid asphalt or the like as will occur to those skilled in the art. The section 20 may comprise composition base flashing as known in the art and it and the built up roof 19 are finished with a coating of crushed stone 21 in liquid asphalt, tar or the like as commonly found in a built up roof construction.

Figure 2:
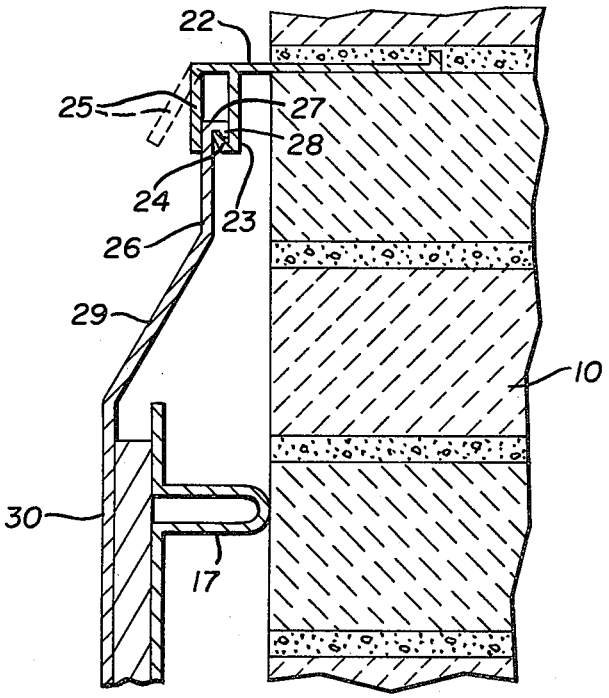
FIG. 2 is an enlarged detail of a portion of the roof and wall seal and cant seen in FIG. 1.

By referring now to FIGS. 1 and 2 of the drawings, it will be seen that a hanger strip 22 is partially embedded in the wall 10 which is illustrated as a masonry wall with Portland cement joining the masonry units and the hanger strip 22 is embedded in one of the cement joints. The hanger strip 22 includes a pair of downwardly depending longitudinally extending members, one of which is a flange 23 having an upturned secondary flange 24 on it's lower end and the other depending member comprises a straight flange 25 which is initially angularly disposed with respect to the hanger strip 22 and with respect to the downturned flange 23 as shown in broken lines in FIG. 2 of the drawings.

As best seen in FIG. 2 of the drawings, a longitudinally extending sheet metal skirt is suspended from the hanger strip 22 in front of and in overlapping relation to the vertical section 15 of the cant and so as to cover the same and the section 20 of roofing material thereagainst as hereinbefore described.

In FIG. 2 of the drawings the sheet metal skirt is illustrated as having a top vertical section 26 with a short horizontal flange 27 on it's uppermost longitudinal edge which in turn is provided with a downturned flange 28 therealong. The short horizontal flange 27 and the downturned flange 28 thereof register over and in the longitudinal hook formation defined by the depending flange 23 with it's upturned flange 24 which as hereinbefore described form a portion of the hanger strip 22. The sheet metal skirt extends downwardly from the vertical section 26 in an angularly disposed portion 29 and a secondary vertical section 30. The lowermost longitudinal edge of the secondary vertical section 30 of the sheet metal skirt is outturned angularly as at 31 as may be seen in FIG. 1 of the drawings and it will be observed by referring thereto that the sheet metal skirt formed of the three sections 26, 29 and 30 with it's downturned flanged upper edge is positioned in the supporting portions of the hanger strip 22 when the outermost flange 25 thereof is in open position as hereinbefore described and as illustrated in broken lines in FIG. 2 of the drawings. When the sheet metal skirt is so positioned, the depending flange 25 of the hanger strip 22 is moved to a vertical position by distorting the same where it engages the upper, outer surface of the vertical section 26 of the sheet metal skirt thus securing it in desired position while at the same time permitting movement between the parts as will occur due to expansion and contraction, etc. as will be understood by those skilled in the art.

It will thus be seen that in the completed roof and wall seal incorporating the cant as disclosed herein a weather tight seal is established between the adjacent face of the wall and the built up roof by the vertical section 15 of the cant and the overlapping section 30 of the sheet metal skirt. The construction is such that the roof may move vertically and/or horizontally relative to the wall 10 with affecting the water tight seal formed by the invention and it will be further observed that ventilation of the area beneath the roof is provided by spacing the vertical section 15 of the cant with respect to the face of the wall 10 adjacent thereto, the path of circulation being upwardly between the wall and the vertical section 15 of the cant and between the flange 17 and the wall 10 and if desired the flange 17 may be notched or apertured to improve circulation thereby and then to atmosphere by passing around and inunder the sheet metal skirt which is not attached to the cant or the roofing material thereon. Thus expanding air pressures beneath the roof are readily vented without damage to the structure or in any way affecting the water tight seal provided by the construction.

Those skilled in the art will observe that when the wall 10 is a poured concrete structure the hanger strip is embedded therein at the time of formation.

Figure 3:
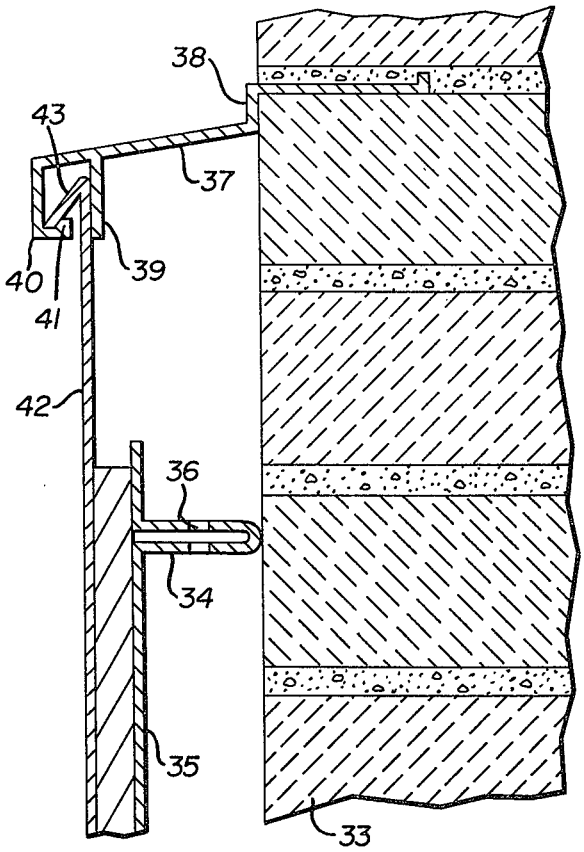
FIG. 3 is an enlarged detail of a modification of the roof and wall seal and cant.

Modifications in the hereinbefore described construction will occur to those skilled in the art and one such modification is illustrated in FIG. 3 of the drawings and by referring thereto it will be seen that a masonry wall 33 is disclosed against which a longitudinally extending horizontally disposed spacing flange 34 of a cant 35 is positioned. The cant 35 is the same as the cant hereinbefore described and illustrated in its entirety in FIG. 1 of the drawings.

In FIG. 3, apertures 36 are formed in the longitudinally extending flange 34 of the cant to provide increased ventilation therethrough as hereinbefore described and a modified form of hanger strip 37 can be seen. The hanger strip 37 has an offset portion 38 intermediate its ends and the outer end of the modified hanger strip 37 has a pair of spaced parallel substantially perpendicular flanges 39 and 40 depending therefrom. The lower end of the flange 40, which is the outermost one of the pair of flanges, has an inturned and upturned secondary flange 41 which defines a hook continuously therealong and the hook 41 is spaced from the flange 39 so that a relatively wide entranceway is provided in which the upper edge of a sheet metal skirt 42 may be engaged and secured. The upper edge of the sheet metal skirt 42 has an angularly disposed downturned continuous flange 43 thereon and is relatively resilient so that the flanged upper edge of the sheet metal skirt 42 can be pushed upwardly into the area between the parallel flanges 39 and 40 on the hanger strip 37 wereupon the lower edge of the angularly disposed flange 43 will snap over and into hook-like engagement with the hook configuration 41 of the hanger strip 37.

It will thus be seen that no distortion or reshaping of the hanger strip is necessary in the form of the invention illustrated in this modification.

It will further occur to those skilled in the art that by forming the spacing flange 34 with its upper and lower surfaces relatively close to one another, it will act as a nail guide and holding means with respect to nail-like fasteners securing part of the built up roof construction thereto.

It will thus be seen that an improved and highly practical roof and wall seal and cant assembly has been disclosed which is quickly and easily installed which forms a practical and efficient water tight closure between a built up roof and a wall while at the same time providing for ventilating the area beneath the roof and additionally being formed of sheet metal shapes or the like which due to their configuration remain in straight longitudinal lengths facilitating easy application to the roof and the wall and the assembly of the structure all as hereinbefore described and illustrated.

Although but two embodiments of the present invention has been illustrated and described, it will be apparent to those skilled in the art that various changes and modifications may be made therein without departing from the spirit of the invention.

Having thus described our invention what we claim is:

1. In a roof and wall seal and cant assembly for forming a weather tight vented closure between a flat roof, the roofing material thereon and an adjacent wall and having a longitudinally extending cant with a horizontal section and a vertical section, said horizontal section arranged to engage said roof, the improvement comprising a longitudinally extending horizontally disposed cross sectionally U-shaped flange formed in said vertical section inwardly of its upper edge and arranged to engage said wall so as to position said vertical section of said cant in spaced relationship to said wall whereby movement of said flat roof toward and away from said wall results in said cant pivoting on said flange, openings formed in said U-shaped flange to provide for ventilation therethrough, a hanger strip engaged in said wall, depending flanges on said hanger strip, at least one of which is distortable and a longitudinally extending outwardly offset skirt having a continuous hook formation on its uppermost edge engaged between said depending flanges and supported thereby with said offset skirt in front of and in overlapping relation to said vertical section of said cant, said cant arranged to receive roofing material on said horizontal and vertical sections thereof.

2. The assembly of claim 1 and wherein said cant has an angular section extending between said horizontal and said vertical sections thereof.

3. The assembly of claim 1 and wherein said skirt is formed with horizontally offset upper and lower portions so that the upper portion may be spaced relatively closer to the wall than the lower portion.

4. The assembly of claim 1 and wherein said longitudinally extending flange is apertured so as to provide ventilation thereby.

5. The assembly of claim 1 and wherein said longitudinally extending flange is formed in said vertical section of said cant below the upper longitudinal edge thereof and parallel thereto.

6. The assembly of claim 1 and wherein said depending flanges are positioned in closely spaced relation to one another and an upturned secondary flange is formed on the lower edge of one of said depending flanges and wherein said continuous hook formation on said skirt is tightly engaged between said depending flanges above said upturned secondary flange.

* * * * *